US005997980A

United States Patent [19]

Matoba et al.

[11] Patent Number: 5,997,980

[45] Date of Patent: Dec. 7, 1999

[54] HOLLOW POLYESTER FIBERS AND TEXTILE ARTICLES COMPRISING SAME

[75] Inventors: Yoshiyuki Matoba; Hironori Gouda; Mikio Tashiro, all of Matsuyama; Reizo Abe, Osaka; Masaaki Sumi, Ooda, all of Japan

[73] Assignee: Teijin Limited, Osaka, Japan

[21] Appl. No.: 09/022,379

[22] Filed: Feb. 12, 1998

[30] Foreign Application Priority Data

Feb. 20, 1997 [JP] Japan ..... 9-036034

[51] Int. Cl.[6] ..... D02G 3/22; D04D 21/04; D04H 13/00; D04B 1/14

[52] U.S. Cl. ..... 428/85; 428/398; 428/397; 428/376; 428/391; 428/904; 442/194; 442/309; 442/338

[58] Field of Search ..... 428/398, 397, 428/85, 904, 376, 391; 442/194, 309, 338

[56] References Cited

FOREIGN PATENT DOCUMENTS

| | | |
|---|---|---|
| 55-12832 | 1/1980 | Japan . |
| 56-316 | 1/1981 | Japan . |
| 57-106708 | 7/1982 | Japan . |
| 61-47807 | 3/1986 | Japan . |
| 61-79486 | 4/1986 | Japan . |
| 61-83307 | 4/1986 | Japan . |
| 62-206008 | 9/1987 | Japan . |
| 62-206009 | 9/1987 | Japan . |
| 62-289642 | 12/1987 | Japan . |
| 63-21914 | 1/1988 | Japan . |
| 62210 | 6/1994 | Japan . |
| 6235120 | 8/1994 | Japan . |
| 6287809 | 10/1994 | Japan . |
| 7238418 | 9/1995 | Japan . |
| 7238419 | 9/1995 | Japan . |
| 7268726 | 10/1995 | Japan . |
| 7268727 | 10/1995 | Japan . |

*Primary Examiner*—Marion McCamish
*Assistant Examiner*—Cheryl Juska
*Attorney, Agent, or Firm*—Sughrue, Mion, Zinn, Macpeak & Seas, PLLC

[57] ABSTRACT

Hollow polyester fibers having a thickness of 0.11 to 8.89 d tex (0.1 to 8.0 denier), a hollow volume (a cross-sectional area ratio of hollow to fiber) of 40 to 85%, and a crystallization degree of 20% or more and crystal size in (0 1 0) plane of 4 nm or more of polyester, has a high resistance to compression and a high recovery from compression and are useful for producing woven and knitted fabric having a high durability, pile sheet materials having high resistance to and recovery from pile prostration, and nonwoven fabrics and artificial leather materials having a high resistance and recovery from compression.

11 Claims, No Drawings

HOLLOW POLYESTER FIBERS AND TEXTILE ARTICLES COMPRISING SAME

BACKGROUND OF THE INVENTION

1. Field of the Invention

The present invention relates to hollow polyester fibers, having a high recovery from compression of the hollow portions of the fibers by external force, and textile articles comprising the hollow polyester fibers, which articles include woven or knitted fabrics having excellent form retention, pile sheet materials having a high recovery of piles from prostration thereof, nonwoven fabrics having a high bulkiness, a soft feeling, a high warm-keeping property and a high resistance to compression and fatigue, and artificial leather materials having good recovery from mechanical deformation.

2. Description of the Prior Art

Hollow polyester fibers having a hollow volume of 40% or more based on the total volume of the fibers are well known.

The hollow polyester fibers can be produced by extracting a melt of a polyester resin through an arc-shaped spinning slit.

To increase the hollow volume of the hollow fibers, usually, the radius of curvature of the arc-shaped slit is increased and the width of the slit is decreased. However, the practical lower limit of the width of the slit is 0.05 to 0.03 mm, because when the slit width is smaller than the above-mentioned practical lower limit, the slit is easily blocked by contaminating solid particles in the polyester resin melt. Also, if the slit width is too large, the extrusion rate of the polyester resin melt per spinning slit is increased, and the resultant fibers have an increased tex (denier). Thus, hollow polyester fibers having a hollow volume of 40% or more can be produced only under limited spinning conditions. In other words, under some spinning conditions, hollow polyester fibers having a hollow volume of 40% or more cannot be obtained.

Also, the conventional hollow polyester fibers having a high hollow volume of 40% or more are disadvantageous in that the hollow polyester fibers are easily compressed and flattened in a fiber-forming procedure and after-processing procedure, and the flattened hollow polyester fibers are difficult to recover the original hollow fiber form, and thus have no effect as hollow fibers. The conventional hollow polyester fibers produced by a process in which a polyester resin melt is extruded through a plurality of hollow fiber-forming slits and the extruded hollow filamentary polyester resin melt streams are drafted and solidified and the resultant undrawn hollow fibers are drawn under conventional fiber-producing conditions, as disclosed in Japanese Unexamined Patent Publications No. 61-79,486, No. 61-83,307, No. 6-2,210, No. 6-235,120, No. 7-238,418, No. 7-238,419, No. 7-268,726 and No. 7-268,727, or by a process in which high hollow polyester fibers are produced by using a specific spinning orifice in which a plurality of slits are connected with each other into a complicated pattern, as disclosed in Japanese Unexamined Patent Publication No. 62-206,009, are disadvantageous in that the polyester crystals in the fibers have a small crystal size in (010) plane, and when the hollow fibers are compressed and flattened, the flattened fibers are difficult to return to the original hollow fiber form.

In another process for producing hollow polyester fibers, as disclosed in Japanese Examined Patent Publications No. 57-54,568 and No. 62-33,915, the hollow fibers are produced at a high spinning speed of, for example, 3000 m/min. or more. This process contributes to increasing the crystal size of the polyester crystals to a small extent. However, the process is still disadvantageous in that the hollow fibers are easily flattened in the spinning procedure and the after-processing procedure. Therefore, this process is not utilized to produce high hollow polyester fibers having a hollow volume of 40% or more.

In another process, as disclosed in Japanese Unexamined Patent Publication No. 6-287,809, hollow polyester fibers are produced by melt-spinning a polyester resin into hollow polyester fibers at a spinning draft of 400 to 4000 at a spinning speed of 1500 m/min. or less, while blowing a cooling gas toward one side of the hollow polyester fibers. Also, in another process, as disclosed in Japanese Unexamined Patent Publications No. 01-47,807 and No. 62-206,008, hollow polyester fibers are produced at a spinning speed of 1500 m/min. or less while rapidly cooling extruded polyester resin hollow filamentary streams at one side thereof. In the publications, it is asserted that the process can produce high hollow polyester fibers having a hollow volume of up to about 60%. However, when the hollow volume is increased to more than 40%, in practice, the resultant hollow fibers are easily flattened in the melt-spinning procedure and the after-processing procedure. Also, the polyester crystal size of the resultant hollow polyester fibers is larger than that produced by the process as disclosed in the above-mentioned Japanese Unexamined Patent Publications No. 61-79,486, No. 61-83,307, No. 6-2,210, No. 6-235,120, No. 7-238,418, No. 7-238,419, No. 7-268,726 and No. 7-268,727. However, the crystal size in the (010) plane is less than 4.0 nm and is still unsatisfactory. Further, the hollow fibers as disclosed in the above-mentioned publications are still disadvantageous in that when the hollow volume is more than 40%, the resultant hollow polyester fibers have various problems derived from the crushing and flattening thereof, and the hollow volume of the hollow fibers is easily changed by external force applied thereto during usage. Therefore, the hollow fibers produced by the above-mentioned process and having a hollow volume of more than 40% have not yet been employed in practice.

Japanese Unexamined Patent Publications No. 57-106,708, No. 62-289,642 and No. 63-21,914 disclose another process for producing synthetic hollow fibers. In the process, hollow filamentary resin melt streams are extruded through a hollow filament-forming slit-shaped nozzle, while introducing an inert gas such as nitrogen gas from the inside of the nozzle to cool the outside and inside of the hollow filamentary resin melt stream, or hollow filamentary resin melt streams are extruded through double pipe-formed spinning orifices, while introducing spontaneously or compulsorily a cooling gas such as air or nitrogen gas from the nozzle into the core portions of the extruded hollow filamentary streams. The process can produce hollow polyester fibers with a high hollow volume of 40 to 70%. However, the crystal size in (010) plane of the polyester crystals is small and thus when the hollow fibers are deformed or flattened, the deformed or flattened hollow fibers are difficult to return to the original form. Also, this process is disadvantageous in that since the spinning orifices or nozzles have a complicated constitution and thus the number of the orifices or nozzles is difficult to increase, and thus the productivity of the hollow fibers is very low and the cost of the hollow fibers is very high. Also, the complicated spinning orifices or nozzles are suitable to produce thick hollow fibers having a thickness of 33.3 d tex (30 denier) or more but not appropriate to produce thin hollow fiber having a thickness of 4.4 to 5.6 d tex (4 to 5 denier) or less. Accordingly, hollow polyester fibers having a small thickness of 8.9 d tex (8.0 denier) or less and a hollow volume of 40% or more have not yet been practically provided.

As mentioned above, the hollow polyester fibers having a small thickness of 8.9 d tex (8.0 denier) and a high hollow volume of 40% or more and exhibiting a high recovery from compression or flattening were not available in practice before the present invention.

SUMMARY OF THE INVENTION

An object of the present invention is to provide hollow polyester fibers having a small individual fiber thickness of 8.9 d tex (8.0 denier) or less and a hollow volume of 40% or more and exhibiting an excellent recovery from deformation or flattening of the fibers, and textile articles comprising the above-mentioned hollow polyester fibers.

Another object of the present invention is to provide hollow polyester fibers which have excellent carding and spinning properties even when the thickness of the individual fibers is about 1.1 d tex (1 denier) or less, and textile articles comprising the hollow polyester fibers as mentioned above. Still another object of the present invention is to provide hollow polyester fibers useful for producing textile articles, for example, woven and knitted fabrics having excellent form retention and hand feeling, pile sheet materials having excellent recovery of piles from prostration thereof and good hand, nonwoven fabrics having a high bulkiness, a soft feeling, an excellent warm-keeping property (warmth) and a high resistance to compression and fatigue, and artificial leather materials having a high recovery from mechanical deformation, and textile articles comprising the above-mentioned hollow polyester fibers.

The above-mentioned objects can be attained by the hollow polyester fibers of the present invention and textile articles comprising the hollow polyester fibers.

The hollow polyester fibers of the present invention each comprises (A) at least one hollow portion extending along the longitudinal axis of the fiber and (B) a shell portion comprising a polyester resin, extending along the longitudinal axis of the fiber and surrounding the hollow portion, and having (1) an individual fiber thickness of 0.11 to 8.89 d tex (0.1 to 8.0 denier); (2) a ratio of a total cross-sectional area of the hollow portion to a total cross-sectional area of the individual fiber of 40 to 85%; (3) a degree of crystallization of the polyester resin in the shell portion of 20% or more; and (4) a crystal size in a (010) plane of the polyester resin in the shell portion of 4 nm or more.

The hollow polyester fibers of the present invention may further have (5) a cross-sectional hollow recovery Ra, which is a proportion ((Sb)/(Sa)) in % of a cross-sectional area (Sb) of the hollow portion of the individual hollow polyester fiber compressed under pressure to such an extent that the cross-sectional area of the hollow portion is decreased to 10% or less based on the original cross-sectional area (Sa) of the hollow portion, then released from the compression, and left to stand under ambient atmospheric pressure at room temperature for one hour, to the original cross-sectional area (Sa) of the hollow portion, of 75% or more; and (6) a cross-sectional hollow recovery Rb which is a proportion ((Sc)/(Sa)) in % of a cross-sectional area (Sc) of the hollow portion of the individual hollow polyester fiber compressed under pressure to such an extent that the cross-sectional area of the hollow portion is decreased to 10% or less based on the original cross-sectional area (Sa) of the hollow portion, released from the compression, left to stand under ambient atmospheric pressure at room temperature for one hour and then heated at a temperature of 130° C. for 10 minutes, to the original cross-sectional area (Sa) of the hollow portion, of 90% or more.

The hollow polyester fibers of the present invention may, further have (7) a silk factor of 15 to 30 calculated in accordance the following equation:

$$SF=ST\times UE^{1/2}$$

wherein SF represents a silk factor, ST represents a tensile strength in g per 1.11 d tex (1.0 denier) of the hollow fibers and UE represents an ultimate elongation in % of the hollow fibers.

In a preferable embodiment of the hollow polyester fibers of the present invention, only one hollow portion is surrounded by a pipe-shaped shell portion of the individual fiber; and in the cross-sectional profile of the individual fiber, when a straight line is drawn through a center point of the individual fiber and a center point of the hollow portion, and two thickness La and Lb of the pipe-shaped shell portion are measured along the drawn straight line, provided that La is equal to or smaller than Lb, a ratio La/Lb is in the range of from 1:1 to 1:5.

The textile article of the present invention comprises the hollow polyester fibers as mentioned above.

For example, the woven or knitted fabric of the present invention comprises 20 to 100% by weight of the hollow polyester fibers as mentioned above and 0 to 80% by weight of fibers other than the hollow polyester fibers.

Also, the textile pile article of the present invention comprises 20 to 100% by weight of the hollow polyester fibers as mentioned above and 0 to 80% by weight of fibers other than the hollow polyester fibers.

Further, the nonwoven fabric of the present invention comprises 20 to 100% by weight of the hollow polyester fibers as mentioned above and 0 to 80% by weight of fibers other than the hollow polyester fibers, and has a thermal recovery in bulkiness represented by a volume ration Hr/Hi, wherein Hi represents a volume in $cm^3/g$ of the nonwoven fabric which has been subjected to three repeated treatments in each of which the nonwoven fabric is compressed under a pressure of 5 $g/cm^2$ at room temperature for 30 seconds and then is released form the compression, and Hr represents a volume in $cm^3/g$ of the nonwoven fabric which has been subjected to the same three repeated treatments as mentioned above and then, heated at a temperature of 60° C. for 5 minutes, of 1.1 or more.

Still further, the artificial leather of the present invention comprises a substrate sheet comprising the hollow polyester fibers as mentioned above, and a coating layer formed on the substrate sheet.

DESCRIPTION OF THE INVENTION

The hollow polyester fibers of the present invention each comprises (A) at least one hollow portion filamentarily extending along the longitudinal axis of the fiber and (B) a shell portion comprising a polyester resin, filamentarily extending along the longitudinal axis of the fiber and surrounding the hollow portion.

The shell portion of the individual hollow polyester fiber comprises a polyester resin. The polyester resins usable for the present invention include homopolyester consisting of repeating ethylene terephthalate units and copolyesters comprising repeating ethylene terephthalate units and other repeating copolymerizing units. Preferably, the polyester resin is selected from homopolymers and copolymers comprising 90 molar % or more of repeating ethylene terephthalate units and 10 molar % or less of other copolymerizing unites, more preferably ethylene terephthalate homopolymer.

The copolymerizing units for the ethylene terephthalate units consists of an acid component and a diol component esterified with each other. The acid component of the copolymerizing units is preferably selected from aromatic dicarboxylic acids, for example, isophthalic acid, 5-sodium sulfoisophthalic acid, diphenyldicarboxylic acid, and naphthalenedicarboxylic acid; aliphatic dicarboxylic acids, for example, oxalic acid, adipic acid, sebacic acid and dodecanoic diacid; and hydroxycarboxylic acids, for example, p-hydroxybenzoic acid and p-β-hydroxyethoxybenzoic acid.

The diol component of the copolymerizing units is preferably selected from aliphatic diols, for example, 1,3-propanediol, 1,6-hexanediol and neopentylglycol; aromatic diols, for example, 1,4-bis(β-hydroxyethoxy) benzene; and alkylene glycols, for example, polyethylene glycol and polybutylene glycol. The copolymerization components as mentioned above may be copolymerized alone or in a mixture of two or more thereof.

There is no limitation to the degree of polymerization (or intrinsic viscosity) of the polyester resin. However, when the polymerization degree of the polyester resin is too high, it causes a disadvantage in that the stability of the melt-spinning procedure decreases and thus the production of the hollow polyester fibers having a small thickness may become difficult. Also, when the polymerization degree is too low, the production of the hollow polyester fibers having a high hollow volume may become difficult. Preferably, the polyester resin for the present invention has an intrinsic viscosity (IV) of 0.45 to 1.00, more preferably 0.6 to 0.7, determined in orthochlorophenol at a temperature of 35° C.

The polyester resin usable for the present invention optionally contains an additive selected from, for example, function-imparting agents, for example, antibacterial agents, hydrophilization agents, acaricides, deodorants, and far infrared ray-irradiating agents; and inorganic particulate fillers, for example, titanium dioxide, silicon oxides, zinc oxide, barium sulfate, zirconium oxides, aluminum oxide, magnesium oxide, calcium oxide and tormarine. The additive may be selected in consideration of the use of the hollow polyester fibers. When the inorganic particulate filler is added, it is preferable that the inorganic filler particles have an average particle size of 1.0 μm or less, more preferably 0.1 to 0.7 μm, and are employed in an amount of 1 to 10% by weight, more preferably 2 to 7% by weight, based on the weight of the polyester resin.

In the hollow polyester fibers of the present invention, the individual fibers have (1) a thickness of 0.11 to 8.89 d tex (0.1 to 8.0 denier) preferably 0.22 to 3.33 d tex (0.2 to 3 denier), more preferably 0.56 to 1.66 d tex (0.5 to 1.5 denier). When the thickness is less than 0.11 d tex (0.1 denier), the stability in the production of the hollow polyester fibers decreases, and the hollow volume of the resultant hollow polyester fibers is decreased. Also, when the thickness is more than 8.89 d tex (8.0 denier), while the stability of the production procedure of the hollow polyester fibers is satisfactory, the thickness of the shell portions of the resultant hollow fibers is large and thus when the hollow fibers are stressed to compress (or crush) them, the resultant deformation strain of the shell portions of the hollow fibers is large and thus the recovery of the crushed hollow fibers from the deformation strain is decreased.

In the hollow polyester fibers of the present invention, the hollow volume (2), which is represented by a ratio in % of a total cross-sectional area of the hollow portion to a total cross-sectional area of the individual fibers, is 40 to 85%, preferably 50 to 70%. When the hollow volume is less than 40%, various effects of the resultant hollow fibers derived from the hollow portion formed therein, namely a comfortable hand (draping property, softness and touch), a high hiding effect, a high bulkiness, a warm-keeping effect (heat-insulating effect) are unsatisfactory. When the hollow volume is more than 85%, the thickness of the shell portion is very small, and thus the resultant hollow fibers exhibit a poor resistance to breakage, a reduced resistance to compressive stress and thus an unsatisfactory form retention.

Each hollow polyester fiber of the present invention may have only one hollow portion or a plurality of hollow portions. Generally, it is difficult to produce hollow polyester fibers each provided with a plurality of hollow portions and having both a high hollow volume and a small thickness of the fibers. Therefore, each of the hollow polyester fibers of the present invention is preferably provided with only one hollow portion. Also, there is no limitation to the cross-sectional form of the hollow portion. Generally, the hollow portion preferably has a true-circular cross-sectional profile which enables the resultant hollow fibers to each have a high hollow volume and a high recovery from deformation.

In the hollow polyester fibers of the present invention, the polyester resin from which the shell portions of the hollow fibers are formed has (3) a degree of crystallization of 20% or more, preferably 22 to 33%, determined by a wide angle X-ray diffraction photography, and the polyester resin crystals have (4) a crystal size of 4.0 nm or more, preferably 4.0 to 9.0 nm, determined based on a half band width of the diffraction peak in (010) plane of the wide angle X-ray diffraction photograph. The crystallization degree of 20% or more and the crystal size of 4.0 nm or more contribute to enhancing the recovery of the hollow form of the hollow fiber from deformation (crushing).

When the crystallization degree is less than 20%, the number of connections between the polyester molecule chains is small and thus the resultant hollow polyester fibers are easily permanently deformed by an external physical force, and exhibit a decreased recovery of the deformed hollow form. Also, when the crystal size in (010) plane is less than 4.0 nm, the bonding power between the polyester molecule chains is weak and thus the resultant hollow fibers exhibit a poor resistance to deformation by the external physical force. Also, in a fixed crystallization degree, the crystal size less than 4.0 nm in the (010) plane causes the number of crystals in a fixed volume to increase, and thus in view of microstructure of the fibers in which a number of polyester molecule chains are connected to each other through connection points consisting of the crystals to form a network, the size of meshes of the network is decreased. Therefore, the deformation of the hollow fibers are fixed permanently even when the degree of deformation is low. Accordingly, the resultant hollow polyester fibers exhibit a low recovery from deformation (crushing).

The preferable ranges of the crystallization degree and the crystal size are variable in response to thermal shrinkage of the hollow fibers. For example, low thermal shrinkage hollow polyester fibers exhibiting a dry heat shrinkage of 1.0 to 5.0% when heated at a temperature of 180° C. for 20 minutes, which dry heat shrinkage under the above-mentioned conditions will be represented by DHS hereinafter, preferably have a crystallization degree of 25 to 35% and a crystal size of 7.0 to 8.5 nm, of the polyester resin. Also, high thermal shrinkage hollow polyester fibers exhibiting a DHS of 40 to 60% preferably have a crystallization degree of 25 to 30% and a crystal size of 4.0 to 5.0 nm, of the polyester resin. When the above-mentioned high thermal shrinkage hollow polyester fibers are subjected to an external crushing force for the first time, the fibers are easily crushed. However, the crushed hollow fibers can be substantially recovered to the original form by applying a heat treatment thereto at a temperature of 100 to 150° C. for 5 to 10 minutes and thereafter, the hollow fibers exhibit a high recovering performance. Further, self-expanding hollow polyester fibers having a DHS of 0 to −10% preferably have a crystallization degree of 20 to 25% and a crystal size of 4.5 to 5.5 nm, of the polyester resin.

In the hollow polyester fibers of the present invention, it is preferable that in the cross-sectional profile of each of the individual hollow fibers, the hollow portion or portions be arranged symmetrically with respect to a center of gravity of the cross-sectional profile of the hollow fiber. Also, it is preferable that only one hollow portion be formed in the individual fiber, and the cross-sectional profile of the hollow portion be concentric with the cross-sectional profile of the hollow fiber. Otherwise, it is preferable that only one hollow portion be surrounded by a pipe-shaped shell potion of in the individual fiber; and in the cross-sectional profile of the individual fiber, when a straight line is drawn through a center point of the individual fiber and a center point of the hollow portion, and two thicknesses La and Lb of the pipe-shaped shell portion are measured along the drawn straight line, and provided that La is equal to or smaller than Lb, a ratio La/Lb be in the range of from 1:1 to 1:5.

When the ratio La/Lb is less than ⅕, the resultant hollow polyester fibers may exhibit an unsatisfactory recovering performance from deformation, especially crushing.

When only one hollow portion is formed in the fiber, the thickness of the shell portion surrounding the hollow portion is preferably 5 $\mu$m or less, more preferably 1.0 to 3.0 $\mu$m. In this case, the resultant hollow polyester fibers exhibit an excellent recovering performance from deformation, and enhanced bulkiness and warm-keeping property, a light weight and a soft touch. However, if the thickness of the shell portion is too small, the production of the hollow polyester fibers may be difficult and the resultant hollow polyester fibers may easily broken or worn during use thereof. The hollow polyester fibers of the present invention are not limited to those having a specific cross-sectional profile. The cross-sectional profile may be circular, triangular or in a poly-lobate form or a cross form.

For example, the hollow polyester fibers are employed for a nonwoven fabric material, a ratio $R_1/R_2$, wherein $R_1$ represents a radius of a smallest circumcircle of a cross-sectional profile of the individual hollow fiber and $R_2$ represents a radius of an inscribed circle of the individual hollow fiber, is preferably in the range from 1.1 to 1.5. The ratio $R_1/R_2$ of 1.1 to 1.5 contributes to enhancing an elastic property and opacifying property of the hollow polyester fiber nonwoven fabric. Also, the hollow portion is not limited to that having a specific cross-sectional profile. The cross-sectional profile of the hollow portion may be in a circle, triangle, poly-lobate or cross form. The circular cross-sectional profile of the hollow portion is preferred in the view point of easy production of the hollow polyester fibers.

The hollow polyester fibers of the present invention preferably have (5) a cross-sectional hollow recovery Ra, which is a proportion ((Sb)/(Sa)) in % of a cross-sectional area (Sb) of the hollow portion of the individual hollow polyester fibers compressed under pressure to such an extent that the cross-sectional area of the hollow portion is decreased to 10% or less based on the original cross-sectional area (Sa) of the hollow portion, then released from the compression, and left to stand under ambient atmospheric pressure at room temperature for one hour, to the original cross-sectional area (Sa) of the hollow portion, of 75% or more; and (6) a cross-sectional hollow recovery Rb, which is a proportion ((Sc)/(Sa)) in % of a cross-sectional area (Sc) of the hollow portion of the individual hollow polyester fiber compressed under pressure to such an extent that the cross-sectional area of the hollow portion is decreased to 10% or less based on the original cross-sectional area (Sa) of the hollow portion, released from the compression, left to stand under ambient atmospheric pressure at room temperature for one hour and then heated at a temperature of 130° C. for 10 minutes, to the original cross-sectional area (Sa) of the hollow portion, of 90% or more.

When Ra is 75% or more and Rb is 90% or more, the resultant textile material comprising the hollow polyester fibers exhibit an excellent recovery from deformation. Namely, the woven and knitted fabrics exhibit an excellent crease recovery, the pile sheet materials exhibit a high pile recovery from prostration, the nonwoven fabrics exhibit a high bulkiness recovery and an enhanced bulkiness duration, and the artificial leathers exhibit a high recovery from deformation.

The hollow polyester fibers of the present invention preferably further have (7) a silk factor of 15 to 30 determined in accordance with the following equation:

$$SF=ST\times UE^{1/2}$$

wherein SF represents a silk factor, ST represents a tensile strength in g per 1.11 d tex (1.0 denier) of the hollow fibers and UE represents an ultimate elongation in % of the hollow fibers. When SF is in the range of from 15 to 30, the resultant hollow fibers can have satisfactory mechanical strength and toughness, and can be easily produced with a high hollow volume of 40% or more. When the silk factor is less than 15, the resultant hollow fibers may have an unsatisfactory mechanical strength and toughness and thus may be not suitable to certain uses. Also, when the silk factor is more than 30, the hollow fibers having a high hollow volume of 40% or more may be difficult to produce.

The hollow polyester fibers of the present invention may be in the form of staple fibers or continuous filaments. The form of the hollow polyester fibers can be established in consideration of the use and the purpose of use. When used for spun yarns and nonwoven fabrics, the hollow fibers are preferably in the form of staple fibers having the number of crimps of 5 to 30 crimps/25 mm, preferably 8 to 25 crimps/25 mm, a percentage of crimp of 8 to 50%, and a fiber length of 20 to 100 mm. These staple hollow fibers exhibit a high stability in carding procedure and are suitable to produce a web having a high quality.

The hollow polyester fibers of the present invention as mentioned above can be produced by a specific melt-spinning method which will be explained below. In the method, a melt of a polyester resin is extruded through a spinneret having hollow fiber-forming spinning orifices, the extruded hollow filamentary streams of the polyester melt are first rapidly cooled right below the spinneret and then gradually cooled, while drafting the extruded and cooled filaments at a draft ratio of 150 or more, preferably 150 to 500, more preferably 200 to 400 and taking up the drafted filaments at a take-up speed of 500 to 2000 m/min., preferably 1000 to 1800 m/min. The above-mentioned melt-spinning conditions are important to obtain both a hollow volume of 40% or more, and a fine structure of fiber having the above-mentioned specific crystallization degree and crystal size of the polyester resin.

When the extruded hollow filamentary polyester resin melt streams are directly subjected to the gradual cooling without the rapid cooling, not only can the high hollow volume of 40% or more not be obtained, but also the crystal size of the polyester resin in the (010) plane in the fine structure of the fiber is decreased. Also, when the spinning draft ratio is less than 150, the stability in the melt-spinning procedure is decreased and the crystal size in the (010) plane of the polyester resin crystals is decreased. Further when the take-up speed exceeds 2000 m/min., while the crystal size in the (010) plane of the resultant polyester resin crystals in the fine structure of the fiber is large and satisfactory, it is difficult to obtain the hollow polyester fibers satisfactory in the high hollow volume of 40% or more, and in the high crystallization degree and the large crystal size of the polyester resin crystals. Further, when the take-up speed is less than 500 m/min., the resultant polyester resin crystals have an unsatisfactory crystal size in the (010) plane. Furthermore, when the spinning draft ratio is too large, the resultant undrawn hollow filaments may exhibit a decreased drawability. Therefore, the draft ratio is preferably 500 or less as mentioned above.

To rapidly cool the extruded hollow filamentary streams of the polyester resin melt, the rapid cooling is preferably started at a location of 5 to 50 mm, more preferably 10 to 30 mm, below the lower end of the spinneret by blowing a cooling air at a temperature of 20 to 35° C. to the streams at a blowing speed of 0.2 to 4.0 m/sec. By the rapid cooling under the above-mentioned conditions, the hollow polyester fibers can be stably melt-spun. When the distance between the lower end of the spinneret and the rapid cooling-starting location is less than 5 mm, the spinneret is rapidly cooled and this rapid cooling causes the extruded hollow filamentary streams to be broken. Also, when the distance is more than 50 mm, the cooling rate on the extruded hollow filamentary streams is insufficient and thus the desired high hollow volume is difficult to obtain.

Also, the blow speed and the temperature of the cooling air should be appropriately balanced each other to obtain a proper and good result. When the temperature of the cooling air is in the range from 20 to 35° C., the blow speed of the cooling air is preferably in the range from 0.2 to 4.0 m/sec. If they are not appropriately balanced each other, for example, the cooling is carried out too strongly, the temperature of the spinneret decreases excessively, the viscosity of the polymer melt increases excessively, and thus the extrusion of the polymer melt becomes difficult, the continuous formation of the hollow portions in the extruded filamentary streams is hindered and the extruded filamentary streams are broken. Also, when the blowing speed of the cooling air is too high, the extruded filamentary streams are strongly shaken and may be undesirably connected to each other.

To obtain the desired high hollow volume and fine structure of the fibers of the present invention, it is preferable that the rapid cooling procedure be carried out in a zone located immediate below the spinneret and having a length of 50 to 150 mm, more preferably 80 to 120 mm. If the length of the rapid cooling zone is less than 50 mm, the resultant rapid cooling effect is insufficient, and thus the hollow polyester fibers having a hollow volume of 40% or more and the fine structure of the fibers may be difficult to produce. Also, if the rapid cooling zone length is more than 150 mm, while the hollow volume of the resultant hollow polyester fibers is satisfactory, the length of gradual cooling zone located below the rapid cooling zone is decreased, and thus the resultant hollow polyester fibers may exhibit a significantly decreased drawability and the resultant fine structure of fiber may not satisfy the requirements of the present invention.

The gradual cooling zone continued to the lower end of the rapid cooling zone preferably has a length of 100 to 400 mm, more preferably 150 to 350 mm. If the gradual cooling zone length falls outside of the above-mentioned range, the resultant fine structure of the fibers may be different from that of the present invention.

In the gradual cooling zone, cooling air is blown toward the rapid cooled filaments at a blow speed of 1/10 to 1/2 of the blow speed of the rapid cooling air. By gradually cooling the filaments under the above-mentioned conditions, the hollow polyester fibers having desired high hollow volume and fine structure of fiber can be obtained.

Namely, in the above-mentioned method of producing the hollow polyester fibers, it is important that the extruded hollow filamentary streams of the polyester resin melt be first rapidly cooled and then gradually cooled. Also, the lengths of the rapid and gradual cooling zones, the blow speeds and temperature of the rapid and gradual cooling air blows should be controlled with appropriate balance each other, to obtain desired results. For example, when the cooling air temperature is 20 to 35° C., the blow speed should be controlled to the above-mentioned level. If the cooling air temperature is too low, the extruded filaments are excessively cooled and thus while a high hollow volume can be obtained, the fine structure of the resultant fibers may be different from that of the present invention. Also, if the cooling air temperature is too high, the extruded filaments may be insufficiently cooled, and a desired high hollow volume may not be obtained and the fine structure of the resultant fibers may be different from that of the present invention.

The undrawn hollow polyester fibers taken up by the above-mentioned procedures are drawn and/or heat treated in consideration of the final use of the fibers. For example, the drawing procedure is carried out at a temperature of 50 to 70° C. at a draw ratio of 1.8 to 5.5. When no heat-treatment is applied, the resultant hollow polyester fibers exhibit a high heat shrinkage. When a heat treatment under tension is applied by using a heating roller or a heating plate, the resultant hollow polyester fibers exhibit a low heat shrinkage. Also, when the drawn filaments are heat-treated in a heating medium, for example, hot water, while relaxing the filaments, for example, by overfeeding the filaments, the resultant hollow polyester fibers exhibit a self-elongating property.

The important items of the above-mentioned method of producing the hollow polyester fibers of the present invention are as follows.

The polyester resin melt extruded through the spinneret forms hollow filamentary streams, and immediate after the formation of the hollow filamentary streams, the outer surface portions of the hollow filamentary streams are rapidly cooled to substantially solidify the outer surface portions in the rapid cooling zone. In this stage, the rapidly cooled hollow filamentary streams have substantially solidified outer surface portions and non-solidified inside portions of the shell portions. In the next gradual cooling zone, the non-solidified inside portions are solidified to form a desired hollow fiber structure.

Since the extruded hollow filamentary polyester resin melt streams are solidified by the specific rapid and gradual cooling procedures while being drafted at an appropriate draft ratio and taken up at an appropriate take-up speed, the specific fine polyester resin crystal structure different from that of conventional hollow polyester fibers is formed in the shell portions of the hollow fibers. The resultant undrawn hollow fibers exhibit an excellent drawability. It assumed that the above-mentioned specific hollow fiber-forming conditions enable the resultant hollow polyester fibers not only to have a high hollow volume, but also to exhibit the above-mentioned specific fine crystal structure of the fibers.

The hollow polyester fibers of the present invention are not limited to those produced by the above-mentioned method and can thus be produced by other methods.

The hollow polyester fibers can be used without any processing or after applying a bulk-raising treatment, for example, a false-twisting treatment or a fluid-jetting treatment (Taslan treatment).

The hollow polyester fibers of the present invention can be employed alone or in combination with other fibers, for example, synthetic fibers different from the hollow polyester fibers of the present invention, or cotton or wool fibers, to produce various textile materials having various specific performance due to a high resistance to compression or crushing and a high recovery from deformation.

For example, various types of woven or knitted fabrics having a high crease recovery and a high resistance to creasing can be prepared from 20 to 100% by weight, preferably 30 to 100% by weight of the hollow polyester fibers of the present invention and 0 to 80% by weight, preferably 0 to 70% by weight of other fibers, because the hollow polyester fibers contribute to enhancing the resistance to crease and the crease recovery. Also, the woven or knitted fabrics comprising the hollow polyester fibers of the present invention exhibit an excellent opacifying effect, warm-keeping effect, softness and an enhanced resiliency even in a low basis weight of the fabric. Also, due to the specific fine crystal structure of the fibers, the hollow polyester fibers exhibit a high dyeability and can be dyed into a dark color in spite of the presence of the hollow portions. When the silk factor is low, the resultant hollow polyester fibers exhibit a high resistance to abrasion and fibril-formation due to the high hollow volume of the fibers. Therefore, even after wearing for a long period of time, the woven or knitted fabrics exhibit a high resistance to whitening and a high piling resistance.

The hollow polyester fibers of the present invention are usable for pile sheet materials. When the pile sheet material comprises, as pile-forming fibers, 20 to 100% by weight, preferably 30 to 100% by weight, of the hollow polyester fibers of the present invention and 0 to 80% by weight, preferably 0 to 70% by weight, of fibers other than the hollow polyester fibers, the resultant pile layer exhibits an excellent resistance to and recovery from prostration of the piles, a high bulky hand and a soft touch even when the basis weight is low, because the hollow fibers have a relatively large cross-sectional area. Also, since the hollow polyester fibers of the present invention have a high resistance to compression or crushing, and a high recovery from deformation, the piles can be easily recovered from a prostrated state to the original upright standing state. Also, the pile sheet materials have a high durability to wearing.

Especially, when the high shrinkage hollow polyester fibers and the low shrinkage hollow polyester fibers of the present invention are used in mixed fibers or in mix-spun yarns, the resultant pile sheet materials exhibit an enhanced resistance to prostration of piles.

The hollow polyester fibers are usable for nonwoven fabrics. The nonwoven fabric comprising 20 to 100% by weight, preferably 50 to 100% by weight, of the hollow polyester fibers of the present invention and 0 to 80% by weight, preferably 0 to 50% by weight, of fibers other than the hollow polyester fibers exhibit high recovery from compression. For example, the nonwoven fabrics have a thermal recovery in bulkiness represented by a volume ratio Hr/Hi wherein Hi represents a volume in $cm^3/g$ of the nonwoven fabric which has been subjected to three times-repeated treatments in each of which the nonwoven fabric is compressed under a pressure of 5 $g/cm^2$ at room temperature for 30 seconds and then is released from the compression, and Hr, represents a volume in $cm^3/g$ of the nonwoven fabric which has been subjected to the same three times-repeated treatments as mentioned above and then heated at a temperature of 60° C. for 5 minutes, of 1.1 or more. When the hollow polyester fibers of the present invention are employed to the use in which the fibers are required to exhibit a low frictional coefficient, for example, for nonwoven fabrics, the surfaces of the hollow polyester fibers are preferably coated with a cured silicone resin layer in an amount of 0.05 to 5% by weight based on the weight of the fibers. The silicone resin-coated hollow polyester fibers of the present invention exhibit not only an enhanced carding property when the hollow fibers are connected to a nonwoven fabric, but also, an enhanced bulkiness, resistance to compression and fatigue, a soft touch and a high draping property. Therefore, the appearance, performance and hand of the nonwoven fabric of the present invention are comparable to those of natural down fabrics.

As a method of coating the fiber surfaces with the silicone resin layer, there is a method in which undrawn fibers are immersed in a treating bath comprising a reactive silicone and then are drawn and heat-treated. In another method, drawn fibers are coated with an expressive large amount of a silicone-treating agent, and then the excess of the silicone-treating agent is removed in a certain manner and then the coated fibers are heat treated. In still another method, crimped fibers are coated with a silicone-treating agent and then heat-treated. In a further method, staple fibers are coated with a silicone-treating agent and then heat treated.

The reactive silicone compounds usable for the present invention are preferably selected from, dimethyl polysiloxane, hydrogenmethyl polysiloxane, aminopolysiloxane and epoxypolysiloxane. These compounds may be used alone or in a mixture of at least two thereof. To uniformly cohere the silicone agent to the fibers, a dispersing agent and a catalyst for accelerating the cross-linking reaction of the compound are preferably employed together with the silicone agent. The coating liquid containing the silicone agent may be in the state of an aqueous emulsion or a straight liquid.

The hollow polyester fibers of the present invention can be employed for artificial leather sheets each comprising a substrate sheet impregnated with a resin. The resin-impregnated sheet is optionally coated with a resin-coating layer. The substrate sheet of the artificial leather sheet preferably comprises the hollow polyester fibers of the present invention in an amount of 30 to 100% by weight, more preferably 40 to 100% by weight, and 0 to 70% by weight, more preferably 0 to 60% by weight of other fibers based on the total weight of the fibers.

In the artificial leather sheets, the hollow polyester fibers of the present invention, preferably contains a fraction consisting of high shrinkage hollow fibers having a heat shrinkage of 45% or more in hot water at a temperature of 70° C., in an amount of 5 to 60% based on the total weight of the hollow fibers. When the high shrinkage hollow fibers are contained in the above-mentioned proportion, the resultant substrate sheet has a high bulkiness and a low apparent density (a light weight). The above-mentioned high shrinkage hollow fibers are easily compressed or crushed by an external force. However, when the compressed hollow fibers are heat treated at a temperature of 100° C. to 150° C. for 5 to 10 minutes, the compressed hollow fibers can regain the substantial original form and thereafter the heat-treated hollow fibers exhibit a high recovery from compression.

Further, the hollow polyester fibers to be employed for the artificial leather sheets of the present invention preferably contain 40 to 95%, based on the total weight of the hollow fibers, of a fraction consisting of latent self-elongative hollow fibers which exhibit a heat shrinkage of −15 to +5% when dry heat-treated at a temperature of 180° C. The term "latent self-elongating hollow fibers" used herein refers to hollow fibers exhibiting a heat shrinkage of 0 or less, namely a heat elongation of 0 or more, at a dry temperature of 60° C. to 70° C. at which a hollow fiber web for the substrate sheet is subjected to a heat-shrinking treatment. The latent self-elongatable hollow fibers cause the resultant substrate sheet for the artificial leather material to be bulky. When the latent self-elongating hollow fibers are employed in combination with the high shrinkage hollow fibers, the resultant substrate sheet exhibit an increased bulkiness and thus contributes to decreasing the weight of the resultant artificial leather sheet. Further, the self-elongating hollow fibers having a DHS of 0 to −10% preferably has a crystallization degree of 20 to 25% and a crystal size of 4.5 to 5.5 nm in the (010) plane, of the polyester crystals.

In the substrate sheet of the artificial leather, the hollow volume of the hollow fibers located in the surface portion thereof is preferably different from that in the inside portion thereof. Namely, it is more preferable that the hollow volume of the hollow fibers located in the surface portion be small and that in the inside portion be large.

When the two types of hollow fibers different in hollow volume are arranged as mentioned above, in a nonwoven fabric for the substrate sheet of the artificial leather, the hollow fibers located in the surface portion are compressed and flattened by a heat-pressing roll, and since heat and pressure of the heat-compression roll are difficult to be transmitted into the inside portion, the hollow fibers located in the inside portion and having a high hollow volume can maintain the original form or can easily recover the original form thereof. In this condition, a resin-treating liquid containing, for example, a polyurethane resin is impregnated in the substrate sheet and fixed therein.

Namely, when the substrate sheet is impregnated with the resin by using the heat-pressing procedure, while the hollow fibers located in the surface portion are flattened, the hollow fibers located in the inside portion retain the high hollow volume and the cross-sectional profile of the hollow portions maintain a substantially circular form. When the resin-impregnated sheet is bent so as to generate wrinkles, the flattened hollow fibers exhibit a high stress against the bending force, and the non-flattened hollow fibers enable the sheet to be easily bent or deformed. Also, the resultant artificial leather exhibit a light weight, a high elasticity, a high bulkiness, a soft touch and a high kick-back property.

In the artificial leather, the resin to be impregnated in or coated on the substrate sheet comprises at least one polymer selected from, for example, polyurethanes, polyamides, polyvinyl chloride, etc. The resin is impregnated in the substrate sheet, and optionally the resin is coated on the resin-impregnated sheet. The impregnation resin is preferably in an amount of 30 to 150% based on the weight of the substrate sheet, and the coating resin is preferably in an amount of 10 to 300%, based on the weight of the resin-impregnated sheet.

When the hollow polyester fibers of the present invention are used alone or in combination with fibers other than the hollow polyester fibers of the present invention, for example, synthetic fibers and cotton and wool fibers, the hollow polyester fibers exhibit various excellent performances derived from a high recovery from deformation or compression and a high resistance to deformation or compression.

In an example of the various excellent performances, the hollow polyester fibers having a low thickness of 1.66 d tex (1.5 denier) which thickness causes the hollow fibers to exhibit a low productivity in carding procedure exhibit an enhanced card-passing property. Namely, since the card-passing property depends on the outer diameter of the fibers, and, for example, the hollow fibers of the present invention having a thickness of 1.11 d tex (1.0 denier) and a hollow volume of 50%, have a outer diameter corresponding to a thickness of 2.22 d tex (2.0 denier) of non-hollow fibers, the 1.11 d tex (1.0 denier) hollow fibers can exhibit a card-passing property corresponding to that of the non-hollow fibers with a thickness of 2.22 d tex (2.0 denier), when the carding conditions are appropriately controlled. Also, when the thickness is 0.56 d tex (0.5 denier) and the hollow volume is 80%, the resultant hollow fibers have an outer diameter corresponding to a thickness of 2.78 d tex (2.5 denier) of non-hollow fibers. This type of hollow fiber exhibits a card-passing property corresponding to that of the non-hollow fibers having a thickness of 2.78 d tex (2.5 denier). However, conventional hollow fibers are easily broken or compressed or flattened during the carding procedure, and thus card-passing property of the conventional hollow fibers is significantly poorer than that of the corresponding non-hollow fibers.

In the fine crystal structure of the hollow polyester fibers of the present invention, the crystallization degree of the polyester resin is 20% or more, and the polyester crystal size in the (0 1 0) plane, is 4.0 nm or more. Namely, the polyester crystals have a relatively large crystal size in the (0 1 0) plane, and the polyester molecule chains are firmly bonded to each other through the large crystals. Since the size of the crystals is large, the number of the crystals is small and thus the distance between the bonding crystals is long. Accordingly, it is assumed that a combination of the bonding effect of the polyester crystals to the polyester molecule chains with the moving effect of the amorphous molecule chains between the bonding crystals contributes to enhancing the permanent deformation-preventing effect of the hollow fibers of the present invention to more than that of conventional polyester hollow fibers in which the polyester crystals have a small size, to preventing the flattening of the hollow portions, and to enabling the compressed or deformed hollow fibers to easily recover the original form thereof by, for example, heating.

Also, since the shell portions of the hollow polyester fibers have a specific fine crystal structure of the polyester resin, the hollow fibers exhibit a high dyeability even though the hollow portions are contained therein, and can be dyed in a dark color, and when the silk factor is low, the hollow portions of the hollow polyester fibers cause the shell portions to exhibit a high resistance to formation of fine fibriles by friction, and thus the resultant textile articles comprising the hollow polyester fibers of the present invention exhibit a high resistance to whitening and an enhanced pill-preventing property.

Since the hollow portions have a high hollow volume of 40% or more, the shell portions have a relatively small thickness in the cross-sections of the hollow polyester fibers of the present invention. As a result, even when the hollow portions are deformed by an external mechanical force, the hollow fibers exhibit a high resistance to the permanent deformation thereof. Namely, hollow fibers having a low hollow volume are more difficult to compress by an external mechanical force than the hollow fibers having a high hollow volume. However, when the low hollow fibers are compressed, the compressed hollow fibers recover the original non-compressed form thereof with difficulty. Compared with the conventional hollow fibers, while the hollow polyester fibers having a high hollow volume are easily compressed or flattened by an external mechanical form, when the mechanical force is removed, the compressed hollow fibers can easily recover the original non-compressed form and exhibit a high durability.

Due to the introduction of the hollow portions, the resultant hollow polyester fibers of the present invention have an increased outer diameter of the fibers, exhibit an excellent recovery from deformation, a light weight, an excellent warm-keeping property. Also, even when the thickness in d tex (denier) of the hollow polyester fibers is small, for example, 1.11 d tex (1 denier) or less, the low d tex hollow polyester fibers can exhibit a satisfactory card-passing property corresponding to that of non-hollow fibers having an outer diameter of the fibers identical to the outer diameter of the hollow polyester fibers. Therefore, the hollow polyester fibers can be converted to a web or sliver with high stability of the carding procedure.

EXAMPLES

The present invention will be further explained by the following examples which are merely representative and do not restrict the scope of the present invention in any way.

In the examples, the following tests were applied (1) Intrinsic viscosity

The intrinsic viscosity of a polyester resin was determined by using orthochlorophenol as a solvent at a temperature of 35° C.

(2) Thickness of fibers

Thickness of fibers was measured in accordance with Japanese Industrial Standard (JIS) L 1015, 7-5-1A method.

(3) Apparent thickness of fibers

By using an image-analyzing system (trademark: PIAS-2, made by PIAS K. K.), a cross-sectional profile of an individual fiber was enlarged at a magnification of 500, and the cross-sectional areas of the fiber was measured.

The apparent thickness of the fiber was determined from the resultant cross-sectional area of the fiber and the specific gravity of the polyester which was supposed as 1.38.

(4) Hollow volume

In the cross-sectional profile of an individual fiber at a magnification of 500, the cross-sectional area of the fiber and the cross-sectional area of the hollow portion were determined and a cross-sectional area ratio in % of the hollow portion to the entire fiber was calculated.

(5) Dry heat shrinkage

A dry heat shrinkage of a fiber was determined in accordance with JIS L 1015-1981, at a temperature of 180° C. for 20 minutes.

(6) Degree of crystallization

A degree of crystallization of polyester resin in fiber was determined from a wide angle X-ray diffraction image of the fiber.

(7) Crystal size in (0 1 0) plane

A crystal size of polyester crystals in (0 1 0) plane was determined from a half band width of a diffraction peak in a (0 1 0) plane in the wide angle X-ray diffraction image.

(8) Form recovery of hollow portion

A tow of hollow polyester filaments was passed in a feed rate of 11,1111 d tex/25 mm width (10,000 deniers/25 mm) through a pair of nipping metallic rollers each having a diameter of 20 mm and a width of 25 mm and spaced 0.05 mm from each other under pressure.

The nipping pressure was controlled so that the cross-sectional area of the hollow portion is decreased to 10% or less of the original cross-sectional area (Sa) thereof.

Then the compressed fiber tow was left to stand under ambient atmospheric pressure at room temperature for 1 hour. The cross-sectional area (Sb) of the hollow portion in the resultant individual fiber was measured.

Further, the fiber tow was further heat-treated at a temperature 130° C. for 10 minutes. The cross-sectional area (Sc) of the hollow portion of the heat-treated individual fiber was measured.

The above-measurements were each repeated 20 times, and an average of the measurement results was calculated.

From the above-mentioned cross-sectional areas (Sa), (Sb) and (Sc), a hollow form recovery Ra at room temperature and a hollow form recovery Rb at 130° C. were calculated as shown below.

$$Ra(\%)=(Sb)/(Sa)\times 100$$

$$Rb(\%)=(Sc)/(Sa)\times 100$$

(9) Thickness of shell portion and Eccentricity of hollow portion

A cross-sectional profile of an individual hollow fiber having only one hollow portion was photographed by an electron microscope. On the photograph, a straight line was drawn through a center point of the cross-sectional profile of the hollow fiber and a center point of the cross-sectional profile of the hollow fibers, and two thicknesses La and Lb ($La \leqq Lb$) of the shell portion along the straight line were measured. The eccentricity of the hollow portion in the individual hollow fibers is represented by a ratio of La to Lb.

(10) Spinnability and Drawability

Spinnability of a polyester resin into hollow fibers are evaluated as follows.

| Class | Spinning result |
|---|---|
| 3 | The number of breakages of filaments was 0.1 or less per spinning orifice per day. The number of adhered filaments was 0.1 or less per spinning orifice per day. Section variability degree V was 8% or less. |
| 2 | The number of breakages of filament was more than 0.1 but not more than 0.2 per spinning orifice per day. The number of adhered filaments was more than 0.1 but not more than 0.2 per spinning orifice per day. Section variability degree V was more than 8% but not more than 9%. |
| 1 | The number of breakages of filaments was more than 0.2 per spinning orifice per day. The number of adhered filaments was more than 0.2 per spinning orifice per day. Section variability degree was more than 9%. |

The term "adhered filament" used herein refers to two or more filaments fuse-adhered to each other to form a single filament.

The term "section variability degree" used herein refers to a scatter in diameters of individual hollow fibers measured at random on a photograph of the cross-sectional profiles of the individual fibers.

Also, a drawability of undrawn hollow filaments are evaluated on the following basis.

| Class | Drawing result |
|---|---|
| 3 | The number of breakages and roll-windings of the filaments was 1 or less per drawing roller per day. The number of undrawn filaments is 5 or less per 100,000 filaments. |
| 2 | The number of breakages and roll-windings of filaments was more than 1 but not more than 3 per drawing roll per day. The number of undrawn filaments was more than 5 but not more than 10 per 100,000 filaments. |
| 1 | The number of breakages and roll-windings of the filaments was more than 3 per drawing roll per day. The number of undrawn filaments was more than 10 per 100,000 filaments. |

(11) Form retention of fabric (Crease resistance)

In accordance with JIS L 1059, Method C (Wrinkle method), testing method of crease resistance of woven fabric, each of three experienced panelists evaluated separately from each other crease resistances of three woven fabrics each in dimensions of 150 mm×280 mm, and an average of the evaluation results of nine woven fabrics was calculated.

The crease resistances were classified into 5 to 1 classes in which class 5 (WR-5) represents a highest crease resistance and class 1 (WR-1) represents a lowest crease resistance.

(12) Warm-keeping property (warmth) of fabric

A fabric piece in a circular form having a diameter of 5 cm was placed on a heat-receiving plate in a thermo-conductivity tester, a heat-supply source (a copper piece) having a temperature of 70° C. was gradually placed on the fabric piece, and the fabric piece was pressed under a load of 4 kg, and the change (increase) in temperature of the heat-receiving plate was recorded on a record paper. At a stage of 30 seconds after the start of heating, the temperature of the heat receiving plate was measured. The warm-keeping percentage of the fabric piece was calculated in accordance with the following equation.

$$\text{Warm-keeping percentage } (\%)=[1-(t-to)/(T-to)]\times 100$$

wherein to represent an initial temperature (28° C.) of the heat-receiving plate, t represents a temperature of the heat-receiving plate at a stage of 30 seconds after the start of heating, and T represents a temperature of the heat supply source, namely 70° C. The test was repeated three times and an average of the test results was calculated.

The average values were classified into four classes as follows

| Class | Warm-keeping property |
|---|---|
| A | Excellent |
| B | Good |
| C | Satisfactory |
| D | Bad |

(13) Apparent density of fabric

Five pieces of a fabric each having an area of 5 $cm^2$ were superposed on each other, the total thickness of the superposed pieces was measured and thus the total volume and total weight of the superposed pieces were measured.

Then a weight of the fabric per unit volume was calculated.

The measured weights per unit weight of the fabric were classified into A to D classes as follows

| Class | Light weight |
|---|---|
| A | Excellent |
| B | Good |
| C | Satisfactory |
| D | Bad |

(14) Opacifying property of fabric (Opacity)

The opacity of fabric was measured in accordance with JIS P 8138.

(15) Hand of fabric

The hand of fabric was evaluated by an organoleptic test and classified into A to D classes as follows

| Class | Hand |
|---|---|
| A | Excellent |
| B | Good |
| C | Satisfactory |
| D | Bad |

(16) Organoleptic tests of bulkiness, softness and refrigerant effect of pile sheet The bulkiness, softness and refrigerant feel of pile sheet were tested by organoleptic test and evaluated in the same manner as in hand of fabric.

(17) Resistance to pile prostration of pile sheet

A bullet having a diameter of 8 cm, and a weight of 2000 g was placed on a front surface of a pile sheet and the pile sheet with the bullet was heated in a hot air dryer at a temperature of 80° C. for 2 hours. Then, the pile sheet was removed from the dryer, and the bullet was removed from the pile sheet.

By using an angle-variable spectral color-measurement system (model: CCMS-3, made by K. K. Murakami Shikisaigijutsu Kenkyusho), L-values of the pile-prostrated portion and pile-non-prostrated portion of the pile sheet were measured.

The L-value was a L value in accordance with CIE color-specification system. In the measurement of the L-value, a light receiver was fixed at an angle of 80 degrees to a perpendicular line for the front surface of the pile sheet, an incident light is irradiated to the light receiver while varying the incident light angle at 10 degrees at a time along a direction from the light receiver to the pile top end of the pile sheet, in a range of from +60 degrees to −60 degrees to the direction along which the piles are prostrated. A largest value of color difference $\Delta L^*(L_A^*-L_B^*)$ between the L* value of the pile-prostrated portion, (namely $L_A^*$ value) and the L* value of the pile-non-prostrated portion (namely $L_B^*$ value) was determined. The largest color difference $\Delta L^*$ represented a resistance (K value) of piles to prostration. The higher the K value, the more conspicuous the prostrated piles.

(18) Initial bulkiness of nonwoven fabric

An initial bulkiness of a nonwoven fabric was measured in terms of specific volume in accordance with JIS L 1097.

A web having dimensions of 20 cm×20 cm and a weight (W) of 40 g was prepared from a fiber mass by using a carding machine. The web was left to stand in the ambient atmosphere for one hour or more, then a thick plate having dimensions of 20 cm×20 cm and a weight of 0.5 g/cm$^2$ was superposed on the web, a bullet (A) having a weight of 2 kg was placed on the thick plate for 30 seconds, the bullet (A) was removed from the thick plate, and the remaining web and thick plate were left to stand for 30 seconds.

The bullet-placing and removing procedures were repeated three times. After the bullet-removed web and thick plate were left to stand for 30 seconds, the heights of the four corner bottoms the thick plate were measured and an height average (h) of the measured height was calculated. The specific volume (initial bulkiness) of the web is calculated in accordance with the following equation:

$$\text{Initial bulkiness } (Hi, \text{cm}^3/\text{g}) = (20 \times 20 \times h/10)/W$$

(19) Initial compressed bulkiness of nonwoven fabric

The initial compressed bulkiness of a nonwoven fabric was measured, in terms of specific volume, in accordance with JIS L 1097.

For the same web as mentioned in (18) was superposed with a thick plate having dimensions of 20 cm×20 cm and a weight of 0.5 g/cm$^2$, and then pressed with a weight (B) having a weight of 4 kg for 30 seconds. Then the heights of four corner bottoms of the thick plate were measured and an average ($h_1$) of the measured height was calculated.

The specific volume (initial compressed bulkiness) of the web was calculated in accordance with the following equation:

$$\text{Initial compressed bulkiness } (\text{cm}^3/\text{g}) = (20 \times 20 \times h_1/10)/W$$

(20) Thermal bulkiness recovery

A web having dimensions of 20 cm×20 cm and a weight (W) of 40 g was prepared from a fiber mass by using a carding machine, and left to stand for one hour or more in the ambient atmosphere.

On the web, a thick plate having dimensions of 20 cm×20 cm and a weight of 0.5 g/cm$^2$ was placed and then a weight (A) having a weight of 2 kg was placed thereon to compress the web for 30 seconds, and then was removed. The remaining web and thick plate were left to stand for 30 seconds in the ambient atmosphere. After the bullet-placing and removing procedures were repeated three times, the thick plate and the web were heat-treated at a temperature of 60° C. for 5 minutes and then left to stand for 30 seconds in the ambient atmosphere.

The heights of four corner bottoms of the thick plate were measured and an average ($h_2$) of the measured heights was calculated.

A bulkiness (Hr) in cm$^3$/g of the web was calculated in accordance with the equation as shown below.

$$Hr(\text{cm}^3/\text{g})\ (20 \times 20 \times h_2/10)/W$$

The thermal bulkiness recovery of the web was represented by a ratio Hr/Hi.

(21) Irregularity in cross-sectional profile of hollow fiber

Irregularity in cross-sectional profile of hollow fiber was represented by a ratio $R_1/R_2$ in which $R^1$ represents a radius of a circumcircle of a cross-sectional outer profile of the fiber and $R_2$ represents a radius of an inscribed circle of the cross-sectional outer profile of the fiber.

(22) Highest card-passing speed of fibers

A fiber mass is fed to a flat carding machine and a highest card passing speed at which the fiber mass can pass through the carding machine without forming neps and fly wasts and without generating unevenness in the resultant web, was established.

Example 1

A polyethylene terephthalate resin having an intrinsic viscosity of 0.64 and containing 0.07% by weight of a titanium dioxide pigment was melt-extruded through an spinneret having 2000 hollow filament-forming spinning orifices at a polymer melt temperature of 268° C. at a extrusion rate of 1260 g/min, and taken up at a take-up speed of 1800 m/min., to produce undrawn hollow polyester filaments having an individual fiber thickness of 3.56 d tex (3.2 denier) and a hollow volume of 50%. In the melt spinning procedure, a rapid cooling zone was formed immediate below a lower end of the spinneret in a length of 100 mm. A rapid cooling air having a temperature of 25° C. was blown at a location of 15 mm below the lower end of the spinneret at a blow speed of 3.0 m/sec. The draft ratio was 400.

A gradual cooling zone formed below the rapid cooling zone had a length of 250 mm. The gradual cooling air was blown at a temperature of 25° C. at a blow speed of 0.5 m/sec.

The resultant undrawn hollow filaments were drawn in a single step in hot water at a temperature of 65° C. at a draw ratio of 3.5, and the drawn hollow filaments were heat-treated under tension by a heating roll at a temperature of 180° C. The resultant hollow polyester filaments had an individual filament thickness of 1.0 d tex (0.9 denier) and a hollow volume of 50%.

The hollow polyester filaments were crimped at a crimp number of 12 to 13 crimps/25 mm, then heat-set with hot air at a temperature of 120° C., and cut into staple fibers having a length of 3 to 100 mm.

The production conditions of the hollow polyester fibers are shown in Table 1 and the test results thereof in Table 2.

Examples 2 to 7 and Comparative Examples 1 to 4

In each of Examples 2 to 7 and Comparative Examples 1 to 4, hollow polyester fibers were produced by the same procedures as in Example 1, except that in the undrawn filament-forming procedures the type of the hollow filament forming orifices and the take-up speed of the undrawn filaments, the position of the rapid cooling air inlet, lengthes of the rapid and gradual cooling zones, the cooling air temperature and blow speed of the cooling air were changed to as shown in Table 1. The resultant undrawn hollow polyester filaments were drawn and heat-treated, crimped, heat set and cut by the same procedures in Example 1. The test results of the resultant hollow polyester staple fibers are shown in Table 2.

TABLE 1

| Item | | Example No. | | | | | | | | | | |
|---|---|---|---|---|---|---|---|---|---|---|---|---|
| | | Example | Comparative Example | | | | Example | | | | | |
| | | 1 | 1 | 2 | 3 | 4 | 2 | 3 | 4 | 5 | 6 | 7 |
| Melt-spinning conditions | Position of hollow portion | Concentric | Concentric | Concentric | Concentric | Concentric | Concentric | Concentric | Concentric | Concentric | Concentric | Eccentric |
| | Take-up speed (m/min) | 1800 | 2500 | 1800 | 700 | 1800 | 1800 | 1800 | 1800 | 1800 | 1600 | 1200 |
| | Draft ratio | 400 | 400 | 700 | 120 | 400 | 400 | 400 | 400 | 470 | 470 | 470 |
| | Position of rapid cooling air inlet (mm) | 15 | 15 | 15 | 15 | 10 | 15 | 15 | 15 | 10 | 10 | 10 |
| | Rapid cooling air temperature (° C.) | 25 | 25 | 25 | 37 | 20 | 25 | 25 | 25 | 25 | 25 | 25 |
| | Rapid cooling air blow speed (m/min) | 3.0 | 3.5 | 3.0 | 1.5 | 3.5 | 3.0 | 3.0 | 3.0 | 4.0 | 4.0 | 4.0 |
| | Position of gradual cooling air inlet (mm) | 250 | — | — | — | — | 250 | 250 | 250 | 250 | 250 | 250 |
| | Gradual cooling air temperature (° C.) | 25 | — | — | — | — | 25 | 25 | 25 | 25 | 25 | 25 |
| | Gradual cooling air blow speed (m/min) | 0.5 | — | — | — | — | 0.5 | 0.5 | 0.5 | 1.5 | 1.5 | 1.5 |
| | Thickness (d tex) of undrawn filament | 3.56 | 2.56 | 3.56 | 10.56 | 3.56 | 3.56 | 3.56 | 3.56 | 3.56 | 9.11 | 25.56 |
| Spinnability | | 3 | 3 | 3 | 2 | 3 | 2 | 3 | 3 | 3 | 3 | 3 |
| Drawing conditions | First drawing temperature (° C.) | 65 | 65 | 65 | 65 | 65 | 65 | 65 | 65 | 65 | 65 | 65 |
| | First draw ratio | 3.5 | 2.5 | 3.5 | 9.0 | 3.5 | 3.5 | 4.4 | 2.5 | 3.5 | 2.8 | 3.0 |
| | Second drawing temperature (° C.) | — | — | — | — | — | — | 90 | — | — | — | — |
| | Second draw ratio | — | — | — | — | — | — | 0.8 | — | — | — | — |
| | Heating roll temperature (° C.) | 180 | 180 | 180 | 180 | 180 | 180 | — | — | 180 | 180 | 180 |
| | Hot air heat setting temperature (° C.) | 120 | 120 | 120 | 120 | 120 | 120 | 100 | 50 | ≧ 120 | 120 | 120 |
| Drawability | | 3 | 3 | 3 | 2 | 3 | 2 | 3 | 3 | 3 | 3 | 3 |

Note: In Examples 6 and 7, the spinneret had 846 and 410 spinning orifices, respectively.

TABLE 2

| Item | Example No. | | | | | | | | | | |
|---|---|---|---|---|---|---|---|---|---|---|---|
| | Example | Comparative Example | | | | Example | | | | | |
| | 1 | 1 | 2 | 3 | 4 | 2 | 3 | 4 | 5 | 6 | 7 |
| Individual fiber thickness (d tex) | 1.0 | 1.11 | 1.11 | 1.11 | 1.11 | 1.11 | 1.11 | 1.56 | 1.11 | 3.33 | 8.89 |
| Hollow volume (%) | 50 | 45 | 43 | 42 | 47 | 50 | 50 | 50 | 80 | 80 | 80 |
| Apparent thickness (d tex) | 2.0 | 2.0 | 1.89 | 1.89 | 2.1i | 2.22 | 2.22 | 2.22 | 5.56 | 16.67 | 44.44 |
| Crystallization degree (%) | 30 | 18 | 21 | 40 | 21 | 30 | 24 | 28 | 30 | 32 | 33 |
| Crystal size (nm) | 8.5 | 4.2 | 3.4 | 3.4 | 4.0 | 8.5 | 7.8 | 8.0 | 8.7 | 8.6 | 8.7 |
| Thickness of shell portion (μm) | 2.07 | 2.21 | 2.33 | 2.34 | 2.12 | 0.7/3.4 | 2.06 | 2.08 | 1.18 | 2.05 | 3.34 |
| La/Lb ratio | 1:1 | 1:1 | 1:1 | 1:1 | 1:1 | 1:5 | 1:1 | 1:1 | 1:1 | 1:1 | 1:2 |
| Silk factor | 19.6 | 24.2 | 28.3 | 34.1 | 29.5 | 19.2 | 22.2 | 21.8 | 19.0 | 20.6 | 21.0 |
| Dry heat shrinkage (%) | 5.0 | 5.2 | 4.6 | 3.9 | 4.7 | 4.7 | −7.5 | 57.0 | 4.5 | 5.5 | 6.0 |
| Hollow form recovery Ra (%) | 77.2 | 18.7 | 19.4 | 17.9 | 23.5 | 42.5 | 78.0 | 20.0 | 80.2 | 77.8 | 79.2 |
| Hollow form recovery Rb (%) | 92.0 | 23.5 | 24.1 | 22.5 | 27.3 | 60.3 | 93.7 | 97.2 | 93.5 | 93.0 | 94.5 |

Examples 8 to 12 and Comparative Examples 5 to 10

In each of Examples 8 to 10 and Comparative Examples 5 to 10, hollow polyester staple fibers having a length of 38 to 100 mm and the properties shown in Table 3 were spun by a ring spinning method at a twist number of 17.1 turns/25 mm to produce a single spun yarns having a yarn count of 20 tex (British cotton yarn count of $30^S$).

The spin yarns were woven into a plain woven fabric having a warp density of 87 yarns/25 mm, a weft density of 68 yarns/25 mm and a width of 127 mm. The woven fabric was scoured by a conventional method and dyed with a disperse dye.

In Example 12, the hollow fibers were blended in an amount of 50% by weight with 50% by weight of cotton fibers. In Comparative Example 9, the hollow fibers were blended in an amount of 15% by weight with 85% by weight of cotton fibers. In each of Example 12 and Comparative Example 9, the scoured woven fabric was subjected to a cotton fiber-bleaching procedure and the dying procedure was omitted. The test results of the fibers are shown in Table 3.

TABLE 3

| | | Example No. | | | | | | | | | | | | | | |
|---|---|---|---|---|---|---|---|---|---|---|---|---|---|---|---|---|
| | | Example | | | | | Comparative Example | | | | | Example | | Comparative Example | | |
| Item | | 8 | 9 | 10 | 11 | | 5 | 6 | 7 | | 8 | 12 | | 9 | | 10 |
| Fiber properties | Individual fiber thickness (d tex) | 1.11 | 1.11 | 3.33 | 1.11 | 1.11 | 1.67 | 1.67 | 1.67 | 1.67 | 3.33 | 1.11 | Cotton | 1.11 | Cotton | 3.33 |
| | Hollow-volume (%) | 50 | 80 | 80 | 70 | 70 | 12 | 0 | 0 | 0 | 40 | 50 | | 50 | | 45 |
| | Crystallization degree (%) | 30 | 32 | 31 | 29 | 25 | 15 | 17 | 17 | 13 | 30 | 30 | | 30 | | 17 |
| | Crystal size (nm) | 8.5 | 8.4 | 8.7 | 4.5 | 5.1 | 6.0 | 7.3 | 1.3 | 1.1 | 8.5 | 8.5 | | 8.5 | | 2.5 |
| | Silk factor | 19.6 | 20.3 | 20.3 | 21.6 | 22.1 | 33.5 | 32.5 | 33.5 | 37.5 | 21.5 | 21.1 | | 21.1 | | 32.0 |
| | Dry heat shrinkage (%) | 2.2 | 2.1 | 2.3 | 62.2 | −7.0 | 3.5 | 3.4 | 61.7 | −7.5 | 3.2 | 2.5 | | 2.5 | | 5.2 |
| | Hollow form recovery Ra | 78 | 79 | 78 | 38 | 76 | 15 | — | — | — | 30 | 77 | | 77 | | 36 |
| | Hollow form recovery Rb | 92 | 96 | 94 | 93 | 94 | 20 | — | — | — | 45 | 93 | | 93 | | 52 |
| | Blend ratio (%) | 100 | 100 | 100 | 50 | 50 | 100 | 100 | 50 | 50 | 100 | 50 | 50 | 15 | 85 | 100 |
| Fabric properties | Form retention (class) | 4.6 | 4.8 | 4.7 | 4.6 | | 3.2 | 3.4 | 2.9 | | 3.6 | 4.3 | | 2.7 | | 3.0 |
| | Warm-keeping property | A | A | A | A | | B | D | C | | B | B | | C | | A |
| | Light weight | A | A | A | A | | B | D | C | | B | B | | C | | A |
| | Opacifying property | 78 | 79 | 77 | 80 | | 65 | 62 | 66 | | 72 | 74 | | 68 | | 67 |
| | Bulkiness | A | A | A | A | | C | D | B | | B | A | | C | | B |
| | Hand | A | A | A | A | | B | D | C | | C | B | | C | | B |
| | Softness | A | A | A | A | | C | B | C | | C | B | | C | | B |
| | Refrigerant effect | A | A | A | A | | C | D | C | | B | B | | C | | B |

Examples 13 to 17 and Comparative Examples 11 to 16

In each of Examples 13 to 17 and Comparative Examples 11 to 16, hollow polyester staple fibers having a length of 38 to 100 mm and the properties shown in Table 4 were spun by a ring spinning method at a twist number of 17.1 turns/25 mm to produce a single spun yarns having a yarn count of 20 tex (British cotton yarn count of $30^S$). The spun yarns were converted to a pile fabric.

In each of Examples 16 and 17 and comparative Examples 13 and 15, two types of the hollow fibers different in thickness as shown in Table 4 were blended to each other.

The test results of the pile fabric are shown in Table 4.

TABLE 4

| | | Example No. | | | | | | | | | | | | | | |
|---|---|---|---|---|---|---|---|---|---|---|---|---|---|---|---|---|
| | | Example | | | | | Comparative Example | | | | | Example | | Comparative Example | | |
| Item | | 13 | 14 | 15 | 16 | | 11 | 12 | 13 | | 14 | 17 | | 15 | | 16 |
| Fiber properties | Individual fiber thickness (d tex) | 1.11 | 1.11 | 3.33 | 1.11 | 1.11 | 1.67 | 1.67 | 1.67 | 1.67 | 3.33 | 1.11 | 1.67 | 1.11 | 1.67 | 3.33 |
| | Hollow volume (%) | 50 | 80 | 80 | 70 | 70 | 12 | 0 | 0 | 0 | 40 | 50 | $(*)_1$ | 50 | $(*)_1$ | 45 |
| | Crystallization degree (%) | 30 | 32 | 31 | 29 | 25 | 15 | 17 | 17 | 13 | 30 | 30 | — | 30 | — | 17 |
| | Crystal size (nm) | 8.5 | 8.4 | 8.7 | 4.5 | 5.1 | 6.0 | 7.3 | 1.3 | 1.1 | 8.5 | 8.5 | — | 8.5 | — | 2.5 |
| | Silk factor | 19.6 | 20.3 | 20.3 | 21.6 | 22.1 | 33.5 | 32.5 | 33.5 | 34.5 | 21.5 | 21.1 | 32.8 | 21.1 | 32.8 | 32.0 |

TABLE 4-continued

| Item | | Example No. | | | | | | | | | | | | | | |
|---|---|---|---|---|---|---|---|---|---|---|---|---|---|---|---|---|
| | | Example | | | | | Comparative Example | | | | | Example | | Comparative Example | | |
| | | 13 | 14 | 15 | 16 | | 11 | 12 | 13 | | 14 | 17 | | 15 | | 16 |
| | Dry heat shrinkage (%) | 2.2 | 2.1 | 2.3 | 62.2 | −7.0 | 3.5 | 3.4 | 61.7 | −7.5 | 3.2 | 2.5 | 3.4 | 2.5 | 3.4 | 5.2 |
| | Hollow form recovery Ra | 78 | 79 | 78 | 38 | 76 | 15 | — | — | — | 30 | 77 | — | 77 | — | 36 |
| | Hollow form recovery Rb | 92 | 96 | 94 | 93 | 94 | 20 | — | — | — | 45 | 93 | — | 93 | — | 52 |
| | Blend ratio (%) | 100 | 100 | 100 | 50 | 50 | 100 | 100 | 50 | 50 | 100 | 50 | 50 | 15 | 85 | 100 |
| Fabric properties | Resistance to pile prostration | 9.6 | 7.8 | 8.4 | 7.2 | | 15.3 | 21.2 | 10.5 | | 15.5 | 13.5 | | 22.7 | | 17.8 |
| | Light weight | A | A | A | A | | C | C | C | | B | B | | C | | B |
| | Bulkiness | A | A | A | A | | C | C | C | | B | A | | C | | B |
| | Softness | A | A | B | A | | C | B | B | | C | A | | B | | B |

Note: $(*)_1$ . . . Flattened fibers

Examples 18 to 25 and Comparative Examples 17 to 20

In each of Examples 18 to 25 and Comparative Examples 17 to 20, hollow polyester staple fibers having a fiber length of 51 mm and the properties shown in Table 5 were subjected to a carding procedure to produce a nonwoven fabric (web) having a basis weight of 60 g/m$^2$.

The test results of the nonwoven fabric are shown in Table 5.

TABLE 5

| Item | | Example No. | | | | | | | | | | | |
|---|---|---|---|---|---|---|---|---|---|---|---|---|---|
| | | Example | | | | | | | | Comparative Example | | | |
| | | 18 | 19 | 20 | 21 | 22 | 23 | 24 | 25 | 17 | 18 | 19 | 20 |
| Fiber properties | Individual fiber thickness (d tex) | 0.56 | 1.11 | 1.67 | 3.33 | 1.11 | 1.11 | 1.11 | 1.11 | 1.11 | 1.67 | 3.33 | 1.11 |
| | Hollow volume (%) | 60 | 50 | 50 | 50 | 50 | 50 | 50 | 70 | 7 | 17 | 25 | 45 |
| | Hollow number | 1 | 1 | 1 | 1 | 3 | 1 | 1 | 1 | 1 | 1 | 1 | 1 |
| | Irregularity ($R_1/R_2$) | 1 | 1 | 1 | 1 | 1 | 1.15 | 1.25 | 1 | 1 | 1 | 1 | 1 |
| | Crystallization degree (%) | 28 | 30 | 29 | 27 | 27 | 27 | 29 | 26 | 20 | 15 | 23 | 17 |
| | Crystal size (nm) | 6.8 | 7.1 | 6.7 | 7.3 | 7.5 | 7.3 | 7.6 | 6.8 | 6.0 | 6.2 | 5.8 | 2.8 |
| | Silk factor | 24 | 23 | 22 | 23 | 23 | 22 | 24 | 22 | 27 | 31 | 34 | 32 |
| | Crimp number (crimps/25 mm) | 13.5 | 13.0 | 13.0 | 12.5 | 13.2 | 13.3 | 13.2 | 13.0 | 13.0 | 13.2 | 13.5 | 13.5 |
| | Crimp degree (%) | 12.5 | 12.0 | 12.0 | 11.5 | 12.1 | 12.4 | 12.5 | 12.5 | 12.5 | 12.5 | 12.7 | 12.5 |
| | Hollow form recovery Ra | 78 | 76 | 77 | 78 | 74 | 73 | 74 | 75 | 22 | 22 | 23 | 26 |
| | Hollow form recovery Rb | 94 | 93 | 96 | 94 | 93 | 94 | 93 | 94 | 24 | 24 | 26 | 28 |
| Non-woven fabric properties | Initial bulkiness (cm$^3$/g) | 63 | 77 | 82 | 92 | 75 | 79 | 83 | 85 | 45 | 55 | 70 | 72 |
| | Initial compressed bulkiness (cm$^3$/g) | 30 | 35 | 37 | 42 | 38 | 40 | 43 | 45 | 14 | 18 | 23 | 30 |
| | Draping property | Good | Good | Good | Good | Good | Good | Good | Excellent | Good | Good | Satisfactory | Good |
| | Thermal bulkiness recovery (Hr/Hi) | 1.4 | 1.6 | 1.6 | 1.6 | 1.5 | 1.4 | 1.3 | 1.7 | 1.1 | 1.1 | 1.1 | 1.1 |
| | Highest card-passing speed (m/min) | 70 | 80 | 86 | 80 | 80 | 80 | 80 | 80 | 50 | 60 | 60 | 70 |

Example 26

By the same procedures as in Example 1, the drawn hollow polyester filaments having a hollow volume of 50% and an individual filament thickness of 1.11 d tex (1.0 denier) were produced.

The resultant drawn hollow polyester filaments were non-heat treated, high shrinkage fibers exhibiting a high heat shrinkage of 45% or more when heated in hot water at a temperature of 70° C. for 20 minutes.

The drawn hollow polyester filaments were dry heat-treated, to convert them to low shrinkage hollow filaments having a heat shrinkage of 10% or less when heated at a temperature of 180° C. for 20 minutes.

Also, the drawn hollow polyester filaments were immersed at an overfeed ratio of 0.8 in hot water at a temperature of 90° C., and then heat-treated in a hot air dryer at a temperature of 100° C. for 20 minutes. The resultant filaments did not shrink or elongate when treated in hot water at a temperature of 70° C. for 20 minutes, and exhibited a dry heat shrinkage of −10% when dry heat-treated at a temperature of 180° C. for 20 minutes. Namely, the hollow polyester filaments are latent spontaneous elongatable filaments. The above-mentioned hollow polyester filaments were subjected to the above-mentioned tests.

The test results are shown in Table 6.

Each of the above-mentioned types of hollow polyester filaments were oiled, crimped and cut into a fiber length of 51 mm.

The high shrinkage hollow polyester fibers and the latent spontaneous elongatable fiber are blended in a weight ratio of 60:40, the blended fibers were carded to form a blend fiber web. The web was subjected to a needle-punching procedure in a needle locker room equipped with punching needles each having a No. 40 regular barb at a punching density of 800 needles/cm$^2$, to provide a needle punched web having a basis weight of 157 g/m$^2$.

The web was immersed in hot water at a temperature of 68° C. for 2 minutes to shrink the web by a area shrinkage of 35%. After vacuum dehydration, the web was dried at a temperature of 50° C. for 5 minutes, to provide a web having a basis weight of 242 g/m$^2$. The web was heat-pressed by holding the web between a heating metal drum and a 60 mesh stainless steel net belt at a temperature of 180° C. for 60 seconds so that the surface area of the web substantially did not change. A nonwoven fabric having a thickness of 1.2 mm and an apparent density of 0.202 g/cm$^3$ was obtained. In the resultant nonwoven fabric, the hollow fibers located in the surface portion are flattened and the nonwoven fabric exhibited a soft touch and did not generate bending lines when bent, and substantially no buckling wrinkles were found on the fabric.

The nonwoven fabric was uniformly impregnated with a coating liquid (available under a trademark of Crysbon MP-185, made by Dainiphon Ink Chemical Co. Ltd.) a 12% polyurethane resin solution in dimethylformamide and carbon black in an amount of 5 parts by weight per 100 parts by weight of the polyurethane resin, squeezed between squeezing rollers and then immersed in hot water at a temperature of 40° C. to coagulate the resin. Then the polyurethane resin-impregnated nonwoven fabric was washed with water until substantially no solvent was formed therein, and dried.

The resultant artificial leather material was subjected to the following tests (23) to (31).

(23) Area shrinkage (S) of web

A surface area ($S_0$) of a needle punched web was measured before subjecting it to a shrinking treatment. Also, a surface area ($S_1$) of the needle punched web was measured after the shrinking treatment.

The area shrinkage (S) in % was calculated in accordance with the following equation $$S(\%)=(S_0-S_1)/S_0\times 100$$

(24) Thickness (mm)

A thickness in mm of the needle punched web before the impregnation with a resin was measured under a load of 150 g/cm$^2$.

Also, a thickness in mm of a resultant artificial leather material impregnated with the resin was measured under a load of 500 g/cm$^2$.

(25) Apparent density (g/cm$^3$)

An apparent density in g/cm$^3$ of the web was calculated from a weight in g per unit area of the web and the thickness of the web.

(26) Softness

The softness of a specimen of a web having dimensions of 20 cm×20 cm was organoleptically evaluated by 10 panelists selected from experts at random, as follows.

| Class | Softness |
|---|---|
| 4 | 8 members indicated soft. |
| 3 | 6 to 7 members indicated soft. |
| 2 | 4 to 5 members indicated soft. |
| 1 | 7 members or more indicated stiff. |

(27) Resistance to buckling

A specimen of a web or an artificial leather material having dimensions of 20 cm×20 cm was bent to such an extent that two faces of the bent specimen facing each other spaced about 5 mm, the bent portion was lightly pressed between two fingers, while moving the lightly pressing fingers from one end to the opposite end of the bent portion. The form of the bend and lightly pressed portion of the specimen was evaluated as follows.

| Class | Form of bent portion |
|---|---|
| 4 | Roundly curved form |
| 3 | Very slightly buckled-form |
| 2 | Slightly buckled form |
| 1 | Completely buckled form |

(28) Bending stiffness (g/cm)

A specimen of an artificial leather material having a width of 2.5 cm and a length of 9 cm was employed.

An end portion of the specimen having a length of 2 cm was fixed horizontally. The remaining portion was held at a holding point 2 cm far from the opposite end of the specimen and bent around the fixing end point of the specimen until the holding point reached a vertical line passing through the fixing end point.

A repulsion force generated on the bent specimen was measured by a strain tester. The bending stiffness was calculated from the measured repulsion force value.

(29) Bending rigidity (kg/cm$^2$)

The bending rigidity in kg/cm of the specimen used in the bending stiffness test (28) was calculated in accordance with the following equation.

$$\text{Bending rigidity (kg/cm}^2)=60\times\text{Bending stiffness (g/cm)}/[\text{Thickness of specimen (mm)}]^3$$

(30) Leather-likeness

A specimen of an artificial leather material having a width of 2.5 cm and a length of 9 cm was bend-compressed to such an extent that the thickness between the uppermost surface and the lowermost surface of the bent specimen, which are parallel to each other, reached to three times the original thickness of the specimen. A repulsion force generated in the bend-compressed specimen was measured by a strain tester.

A ratio of the measured repulsion force value to the bending stiffness value (g/cm) of the specimen represents the leather-likeness of the specimen.

The higher the ratio, the higher the leather-likeness of the specimen.

(31) Flexural durability

The flexural durability of an artificial leather material was determined in accordance with the 525 method of JIS K 6505.

The test results are shown in Table 6.

The resultant artificial leather material had a light weight, a high softness, a high elasticity in the direction of the thickness, and generated no bending lines when bent, and thus was useful in practice.

Example 27

An artificial leather material was produced and tested by the same procedures as in Example 26, except that the blend weight ratio of the high shrinkage hollow polyester fibers to the latent spontaneously elongatable hollow polyester fibers was changed to 90:10. The test results are shown in Table 6.

Example 28

An artificial leather material was produced and tested by the same procedures as in Example 26, except that as high shrinkage fibers, hollow polyester fibers having an individual fiber thickness of 0.56 d tex (0.5 denier), a hollow volume of 75% and an apparent fiber thickness of 2.22 d tex (2.0 denier) were employed.

The test results are shown in Table 6.

Example 29

An artificial leather material was produced and tested by the same procedures as in Example 26, except that as the high shrinkage fibers, hollow polyester fibers having an individual fiber thickness of 3.33 d tex (3.0 denier), a hollow volume of 70%, and an apparent thickness of 11.11 d tex (9.99 denier) were employed.

The test results are shown in Table 6.

TABLE 6

| Item | | Unit | Example No. | | | | | | | |
|---|---|---|---|---|---|---|---|---|---|---|
| | | | Example 1 | | Example 2 | | Example 3 | | Example 4 | |
| | | | High shrinkage fibers $(*)_1$ | Spontaneous elongatable fibers $(*)_2$ | High shrinkage fibers $(*)_1$ | Spontaneous elongatable fibers $(*)_2$ | High shrinkage fibers $(*)_1$ | Spontaneous elongatable fibers $(*)_2$ | High shrinkage fibers $(*)_1$ | Spontaneous elongatable fibers $(*)_2$ |
| Fiber | Individual fiber thickness | d tex | 1.11 | 1.11 | 1.11 | 1.11 | 0.56 | 0.56 | 3.33 | 3.33 |
| | Hollow volume | % | 50 | 50 | 50 | 50 | 75 | 75 | 70 | 70 |
| | Crystallization degree | % | 29 | 25 | 29 | 25 | 30 | 27 | 29 | 26 |
| | Crystal size | nm | 4.5 | 5.1 | 4.5 | 5.1 | 4.6 | 5.3 | 4.7 | 5.3 |
| | Hollow form recovery Ra | % | 38 | 76 | 38 | 76 | 39 | 77 | 38 | 76 |
| | Hollow form recovery Rb | % | 93 | 94 | 93 | 94 | 92 | 93 | 94 | 92 |
| | Silk factor | — | 21.6 | 22.1 | 21.6 | 22.1 | 19.8 | 20.6 | 19.8 | 21.3 |
| | Thickness of shell portion (La) | μm | 2.07 | 1.98 | 2.07 | 1.98 | 1.02 | 1.12 | 2.61 | 2.62 |
| | Hollow eccentricity ratio (Lb/La) | | 1.1 | 1.2 | 1.1 | 1.1 | 1.2 | 1.1 | 1.1 | 1.2 |
| | Heat shrinkage at 70° C. | % | 45 | — | 46 | — | 45 | – | 44 | — |
| | Dry heat shrinkage at 180° C. | % | — | −10 | — | −10 | — | −9 | — | −8 |
| Substrate sheet | Fiber blend ratio | % | 60 | 40 | 90 | 10 | 60 | 40 | 60 | 40 |
| | Weight of needle-punched web | $g/m^2$ | 157 | | 137 | | 157 | | 159 | |
| | Web-shrinking treatment temperature | ° C. | 68 | | 68 | | 68 | | 68 | |
| | Web shrinkage | % | 35 | | 43 | | 36 | | 35 | |
| | Weight of shrinking-treated web | $g/m^2$ | 242 | | 240 | | 246 | | 244 | |
| | Spontaneous elongation treatment temp | ° C. | 180 | | 180 | | 180 | | 180 | |
| | Thickness of spontaneously elongated web | mm | 1.2 | | 1.2 | | 1.15 | | 1.22 | |
| | Apparent density of web $(*)_3$ | $g/cm^3$ | 0.202 | | 0.2 | | 0.21 | | 0.2 | |
| | Softness of web $(*)_3$ | — | 3 | | 4 | | 3 | | 3 | |
| | Buckling resistance | — | 3 | | 4 | | 3 | | 3 | |
| Artificial leather | Amount of impregnated polyurethane [Polyurethane-impregnated sheet] | % | 32 | | 32 | | 32 | | 32 | |
| | Bending stiffness | g/cm | 2 | | 1.8 | | 1.8 | | 2.2 | |
| | Bending rigidity | kg/cm | 69 | | 62 | | 71 | | 73 | |
| | Leather-likeness | — | 60 | | 67 | | 62 | | 58 | |
| | Buckling resistance | — | 3 | | 4 | | 3 | | 3 | |
| | Flexural durability | | >105 | | >105 | | >105 | | >105 | |

[Note] $(*)_1$ . . . High shrinkage hollow polyester fibers
$(*)_2$ . . . Spontaneous elongatable hollow polyester fibers
$(*)_3$ . . . Spontaneously elongated web As mentioned above in detail, the hollow polyester fiber of the present invention has a high resistance to compression and crushing, and if crushed, can easily recover the original form thereof, while the hollow volume is very high. Therefore, the hollow polyester fibers of the present invention are useful for producing various types of textile materials, for example, woven and knitted fabrics having a light weight, a high warm-keeping property, a high bulkiness, a high resiliency, opacifying effect, a high form retention, a high crease resistance, a satisfactory dyeability, a high resistance to fibrile-formation and a high pilling resistance; pile sheet materials having piles formed from the hollow fibers and exhibiting a high resistance to pile prostration, a light weight, a high bulkiness, a high softness, and a high duration for use; nonwoven fabrics having a light weight, a high bulkiness, a high softness, a high resistance to compression and fatigue and a high draping property; artificial leather materials, winter quilting wears, and wadding fibers for overlets and pillows.

We claim:

1. A hollow polyester fiber comprising (A) at least one hollow portion extending along the longitudinal axis of the fiber and (B) a shell portion comprising a polyester resin, extending along the longitudinal axis of the fiber and surrounding the hollow portion, and having (1) an individual fiber thickness of 0.11 to 8.89 d tex (0.1 to 8.0 denier); (2) a ratio of a total cross-sectional area of the hollow portion to a total cross-sectional area of the individual fiber of 40 to 85%; (3) a degree of crystallization of the polyester resin in the shell portion of 20% or more; and (4) a crystal size in a (0 1 0) plane of the polyester resin in the shell portion of 4 nm or more.

2. The hollow polyester fiber as claimed in claim 1, further having (5) a cross-sectional hollow recovery Ra, which is a proportion ((Sb)/(Sa)) in % of a cross-sectional area (Sb) of the hollow portion of the individual hollow polyester fiber compressed under pressure to such an extent that the cross-sectional area of the hollow portion is decreased to 10% or less based on the original cross-sectional area (Sa) of the hollow portion, then released from the compression, and left to stand under ambient atmospheric pressure at room temperature for one hour, to the original cross-sectional area (Sa) of the hollow portion, of 75% or more; and (6) a cross-sectional hollow recovery Rb, which is a proportion ((Sc)/(Sa)) in % of a cross-sectional area (Sc) of the hollow portion of the individual hollow polyester fiber compressed under pressure to such an extent that the cross-sectional area of the hollow portion is decreased to 10% or less based on the original cross-sectional area (Sa) of the hollow portion, released from the compression, left to stand under ambient atmospheric pressure at room temperature for one hour and then heated at a temperature of 130° C. for 10 minutes, to the original cross-sectional area (Sa) of the hollow portion, of 90% or more.

3. The hollow polyester fiber as claimed in claim 1, further having (7) a silk factor of 15 to 30 calculated in accordance with the following equation:

$$SF=ST\times UE^{1/2}$$

wherein SF represents a silk factor, ST represents a tensile strength in g per 1.11 d tex (1 denier) of the hollow fibers and UE represents an ultimate elongation in % of the hollow fiber.

4. The hollow polyester fiber as claimed in claim 1, wherein only one hollow portion is surrounded by a pipe-shaped shell portion of the individual fiber; and in the cross-sectional profile of the individual fiber, when a straight line is drawn through a center point of the individual fiber and a center point of the hollow portion, and two thicknesses La and Lb of the pipe-shaped shell portion are measured along the drawn straight line, provided that La is equal to or smaller than Lb, a ratio La/Lb is in the range of from 1:1 to 1:5.

5. The hollow polyester fiber as claimed in claim 4, wherein the thickness Lb is 5 $\mu$m or less.

6. A textile article comprising a plurality of the hollow polyester fiber as claimed in any of claims 1 to 5.

7. A woven or knitted fabric comprising 20 to 100% by weight of a plurality of hollow polyester fiber as claimed in any of claims 1 to 5 and 0 to 80% by weight of fibers other than the hollow polyester fibers.

8. A pile sheet material comprising 20 to 100% by weight of the a plurality of hollow polyester fiber as claimed in any of claims 1 to 5 and 0 to 80% by weight of fibers other than the hollow polyester fibers of any of claims 1 to 5.

9. A nonwoven fabric comprising 20 to 100% by weight of a plurality of hollow polyester fiber as claimed in any of claims 1 to 5 and 0 to 80% by weight of fibers other than hollow polyester fibers of any claims 1 to 5, and having a thermal recovery in bulkiness represented by a volume ratio Hr/Hi wherein Hi represents a volume in $cm^3/g$ of the nonwoven fabric which has been subjected to three times repeated treatments in each of which the nonwoven fabric is compressed under a pressure of 5 $g/cm^2$ at room temperature for 30 seconds and then is released from the compression, and Hr represents a volume in $cm^3/g$ of the nonwoven fabric which has been subjected to the same three times repeated treatments as mentioned above and then, heated at a temperature of 60° C. for 5 minutes, of 1.1 or more.

10. A nonwoven fabric comprising 20 to 80% by weight of a plurality of hollow polyester fiber as claimed in any of claims 1 to 5 and 0 to 80% by weight of fibers other than hollow polyester fibers as claimed in any of claims 1 to 5, wherein the hollow polyester fibers are coated with a cured silicone resin layer in an amount of 0.05 to 5.0% by weight based on the hollow polyester fibers.

11. An artificial leather material comprising a substrate sheet comprising a plurality of hollow polyester fiber as claimed in any of claims 1 to 5, and impregnated with a resin.

* * * * *